United States Patent [19]

Holl

[11] Patent Number: 4,784,218

[45] **Date of Patent: * Nov. 15, 1988**

[54] FLUID HANDLING APPARATUS

[76] Inventor: Richard A. Holl, #2 - 1507 Upper Middle Road, Burlington, Ontario, Canada, L7P 4M5

[ * ] Notice: The portion of the term of this patent subsequent to Jun. 2, 2004 has been disclaimed.

[21] Appl. No.: 899,454

[22] Filed: Aug. 22, 1986

Related U.S. Application Data

[63] Continuation of Ser. No. 739,777, Jun. 3, 1985, Pat. No. 4,670,103, which is a continuation of Ser. No. 438,300, Nov. 1, 1982, abandoned.

[51] Int. Cl.[4] ..... F28F 1/40; F28F 9/24

[52] U.S. Cl. ..... 165/109.1; 165/159; 165/174; 138/38; 422/312

[58] Field of Search ..... 165/174, 109.1, 179, 165/159; 138/38

[56] References Cited

U.S. PATENT DOCUMENTS

| | | | |
|---|---|---|---|
| 155,936 | 10/1874 | Fell . | |
| 172,302 | 1/1876 | Dean | 138/38 |
| 1,203,625 | 11/1916 | Jacobus | 138/38 |
| 1,283,550 | 11/1918 | Parker . | |
| 1,313,624 | 8/1919 | Evans et al. . | |
| 2,034,822 | 3/1936 | Morrow . | |
| 2,068,477 | 1/1937 | Woodson | 138/38 |
| 2,070,427 | 2/1937 | Faunce . | |
| 2,081,612 | 5/1937 | Woodson | 138/38 |
| 2,300,058 | 10/1942 | Osborn, Jr. et ala. | 138/38 |
| 2,462,838 | 3/1949 | Brierty et al. | 138/38 |
| 2,709,128 | 5/1955 | Krause . | |
| 2,897,838 | 8/1959 | Webber et al. | 138/38 |
| 4,211,277 | 7/1980 | Grosz-Roll et al. . | |
| 4,443,389 | 4/1984 | Dodds | 165/179 |

FOREIGN PATENT DOCUMENTS

| | | | |
|---|---|---|---|
| 0042613 | 12/1981 | European Pat. Off. . | |
| 367584 | 9/1906 | France . | |
| 446438 | 10/1912 | France . | |
| 1249001 | 11/1960 | France . | |
| 478992 | 10/1975 | U.S.S.R. | 138/38 |
| 730375 | 5/1955 | United Kingdom . | |
| 2069676 | 8/1981 | United Kingdom . | |

*Primary Examiner*—Albert W. Davis, Jr.
*Attorney, Agent, or Firm*—Rogers & Scott

[57] ABSTRACT

The invention provides fluid handling apparatus which may be heat exchange apparatus or fluid reaction apparatus. The apparatus is provided with an interrupter structure for disrupting the fluid boundary layers at the walls of the apparatus and promoting mixing of the separated boundary layers with the adjacent core layers. One interrupter structure comprises a plurality of longitudinally-spaced interrupter elements mounted on a core rod, each element comprising a plurality of blade-like members each of at least approximately spherical segment profile in side elevation, the members extending mutually radially outward relative to one another to touch or nearly touch the said surface or surfaces adjacent the elements. The elements are spaced longitudinally from one another the distance required to provide wake intererence flow of the fluid, wherein the vortex upstream of one element cooperates with the vortex downstream of the next element in the fluid path. In a shell and tube type exchanger the bladed type of structure may be provided in the tubes interiors, while a spherical type of interrupter structure is provided in the shell contacting the tube exteriors.

13 Claims, 3 Drawing Sheets

FLUID HANDLING APPARATUS

This application is a continutation of application Ser. No. 06/739,777, filed June 3, 1985, (now U.S. Pat. No. 4,670,103) granted June 2, 1987, which application is a continuation of prior application Ser. No. 06/438,300, filed No. 1, 1982, now abandoned.

FIELD OF THE INVENTION

This invention is concerned with improvements in or relating to fluid handling apparatus, such as heat exchanger apparatus and fluid reactor apparatus.

REVIEW OF THE PRIOR ART

It is of course a constant aim in all fields of manufacture to lower costs both of the apparatus itself and of its cost of operation and maintenance. In the case of heat exchange apparatus there is therefore a constant endeavour to improve efficiency, so that the cost of operation is reduced directly and so that the apparatus is smaller in size, which in itself is usually a desirable characteristic, such size reduction resulting in a requirement for less material in its fabrication. This reduction in material requirement is especially important in apparatus employed with corrosive fluids and in difficult environments when expensive corrosion-resistant materials must be used. It is also an endeavour to provide as great a freedom as possible from fouling, together with ease of assembly and disassembly, so as to give accompanying consequent economy in maintenance. There are similar advantages to be obtained in the case of fluid reaction apparatus, resulting from increases in efficiency of the fluid mixing and efficiency of contact with catalytic material, and also in the case of fluid reaction apparatus that has heat exchange capability to take account of the exothermic or endothermic nature of the reactions involved.

An improved heat exchange process and apparatus are disclosed in my prior European Patent application Ser. No. 81104809.9, (Publication No. 0 042 613), filed June 22, 1981 and published Dec. 30, 1981, the disclosure of which is incorporated herein by this reference. In this process and apparatus the fluid flow takes the form of a non-turbulent boundary layer or layers immediately adjacent to the heat transfer surface and a non-turbulent core layer interfacing with the boundary layer or layers. An interrupter structure is provided within the flow passage to interrupt in as non-turbulent a manner as possible the said boundary layer or layers at a plurality of spaced interruption spots, whereby parts of the interrupted boundary layer separate from the heat transfer surface and mix with the core layer to effect heat transfer between the surface and the core layer. This structure consists of densely-packed convex sphere segments each arranged with a part of its convex surface touching or almost touching the heat transfer surface. Such a structure provides a very high coefficient of heat transfer without a disproportionate increase in the pumping power required to move the fluid through the apparatus.

DEFINITION OF THE INVENTION

It is an object of the invention to provide a new fluid boundary layer interrupter structure for fluid handling apparatus.

In accordance with the present invention there is provided in a fluid handling apparatus an interrupter structure adapted for pointwise interruption of the boundary layer of a fluid flow over a surface or surfaces of the apparatus immediately adjacent to the interrupter structure, the said structure comprising:

a multiplicity of bladed interrupter elements disposed longitudinally relative to one another in the direction of flow of the fluid;

each bladed interrupter element comprising a common core and at least three blade-like members extending mutually outwardly from the common core so as to separately touch or nearly touch the said apparatus surface or surfaces immediately adjacent to the respective element, each blade-like member being of at least approximately spherical segment profile in side elevation, so that the portion thereof most closely adjacent to the respective apparatus surface protrudes into the said fluid flow boundary layer for pointwise interruption thereof.

Also preferably the spacing between immediately successive interrupter elements is such as to produce wake interference flow in the fluid.

The fluid handling apparatus may comprise heat exchange apparatus in which the interrupter elements are disposed adjacent the surface of a wall through which heat exchange takes place.

The fluid handling apparatus may comprise a fluid reactor in which the interrupter structure is coated with a material exhibiting reactive and/or catalytic properties toward the fluid.

DESCRIPTION OF THE DRAWINGS

Fluid handling apparatus constituting preferred embodiments of the invention will now be described, by way of example, with reference to the accompanying diagrammatic drawings, wherein:.

DESCRIPTION OF THE PREFERRED EMBODIMENTS

Figure 1:
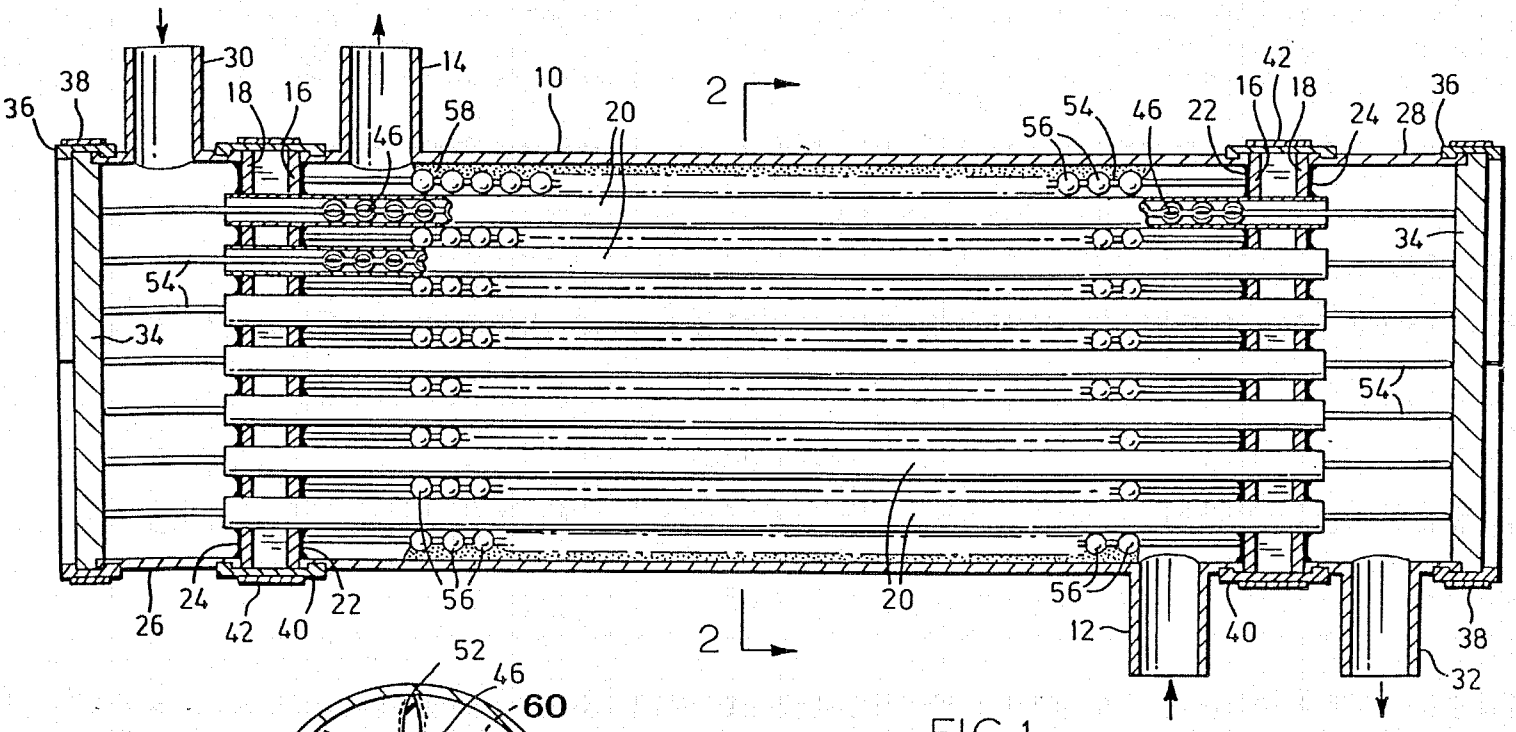
FIG. 1 is a longitudinal section through a heat exchanger embodying the invention, taken on the line 1—1 of FIG. 2, parts only of some of the tubes thereof being shown broken away and parts of structures being shown in phantom to avoid excessive detail.
Figure 2:
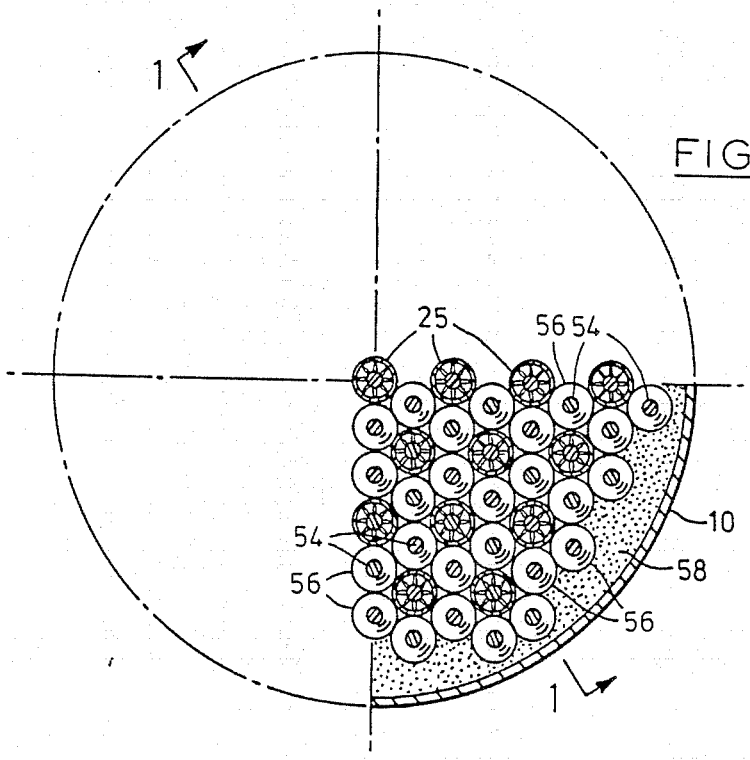
FIG. 2 is a part transverse section through the apparatus of FIG. 1, taken on the line 2—2 of FIG. 1, only the lower right quadrant being shown in full to avoid excessive detail.

The heat exchanger of FIGS. 1 and 2 is of shell-and-tube type comprising a central shell member 10 having inlet 12 and outlet 14 for the fluid that is to pass in the shell around the outside of the tubes. The two ends of the shell member 10 are closed by two respective tube sheet assemblies, each consisting of two spaced tube sheets 16 and 18 through which pass the ends of a plurality of parallel tubes 20 so as to be supported by the tube sheets. The joints between the tubes and the apertures in the tube sheets through which they pass, and also the joints between the tube sheet assemblies and the adjacent shell members, are sealed by specially shaped unitary gaskets 22 and 24. Any of the two fluids that leak through the gaskets enters the space between the tube sheets and can be vented to atmosphere without cross-contamination of the fluids.

Two subsidiary like end members 26 and 28 are mounted on the respective ends of the central shell member 10 abutting the respective tube sheet assemblies to form respective plenums for the fluid that enters and discharges from the interiors of the tubes 20, and are provided respectively with inlet 30 and outlet 32 for such fluid. The ends of the shell end members 26 and 28 are closed by respective end plates 34 held to the members by respective encircling removable split rings 36 and tensioned band clamps 38. The tube sheet assemblies and the subsidiary members are held assembled with the central shell 10 in similar manner by means of encircling split rings 40 and tensioned band clamps 42, the split rings having radially inwardly extending projections that engage in respective circumferenctial grooves in the shell members.

Each tube 20 has mounted therein a respective fluid flow interrupter structure 44 of the invention comprising a multiplicity of longitudinally spaced interrupter elements 46, which in this embodiment are mounted longitudinally spaced from one another along the length of the tube on an elongated axial core element rod 48 of small diameter relative to the overall diameter of the elements. The ends of this rod are free of the interrupter elements and extend out of the tubes 20 through the respective plenums into contact with the adjacent faces of the removable end plates 34, so that the interrupter structures are maintained in fixed longitudinal positions in the tubes.

Figure 3:
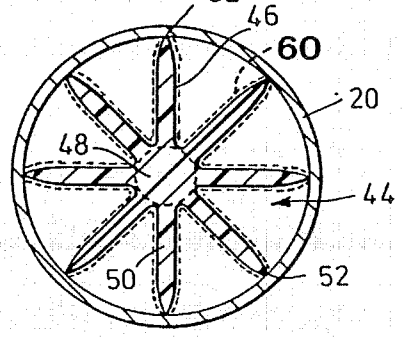
FIG. 3 is a transverse cross-section to an enlarged scale of an interrupter element of the apparatus of FIGS. 1 and 2.

As is seen most clearly in FIGS. 2 and 3, each interrupter element 46 consists of a plurality of equal length blade like members 50 extending mutually radially outwards from the core rod 48 until they touch, or at least almost touch, the inside cylindrical wall of the respective tube. As is seen most clearly in FIGS. 1, 4, and 5 each blade like member is of convex curvilinear profile as seen in side elevation, so that it has only effectively a point 52 of its circumference in contact with the tube inner wall, or immediately adjacent thereto.

It is known to those skilled in the art that a fluid flowing within a passage, such as a tube 20, has a very thin virtually stationary boundary layer at the tube inner wall which insulates the wall surface from the main body of the fluid flowing in a core layer interfacing with the boundary layer, the boundary layer therefore reducing the heat transfer between the tube inner surface and the core layer. It is also known that an unobstructed boundary layer increases progressively in thickness in the direction of fluid flow, which will increase its insulating effect. Proposals have therefore been made hitherto to disrupt such boundary layers by roughening or ridging the surfaces over which they flow, but such proposals have the effect of also increasing to a disproportionately greater extent the pumping power required to move the fluid through the passage because of the turbulence that is generated in the fluid.

In apparatus of the invention the boundary layer at the tube inner faces is interrupted in a "spot-wise" manner at circumferentially and longitudinally spaced spots by means of the fluid flow interrupter structure of the invention, while maintaining a non-turbulent fluid flow in the main body of the fluid constituted by the core layer. In the apparatus of the invention not only are the heat transfer surfaces not roughened, etc., but on the contrary they are made as smooth as is economically possible, to the extent that in some embodiments both the inner and the outer surfaces of the tubes 20 may be polished to the desired degree of smoothness. It will be seen that the blade-like members of each element intercept the boundary layer at a number of circumferentially-spaced spots surrounding the element corresponding to the number of members, and this occurs for each element of the structure along its length. The disruption of the boundary layer at the multitude of longitudinally and circumferentially spaced spots ensures that it stays thin, while the manner of its disruption ensures that turbulence is avoided that would cause unduly high friction drag.

It will be noted that the blade-like members of the interrupter elements are relatively thick at their root connections with the axial core rod and taper smoothly and progressively radially outwards until they terminate in a thin but smoothly rounded tip at or very closely adjacent to the tube inner surface. It will be understood by those skilled in the art that, because of usual manufacturing tolerances in the manufacture of the tubes and the interrupter structures, and also because of the need to be able easily to insert the structures into and remove them from the tubes, there may not always be positive contact at a particular interruption spot between the blade member and the tube interior wall, but the required effect will be obtained as long as the blade edge intrudes into the boundary layer. In a typical example of a small heat exchanger e.g. of capacity 20 liters/minute, and in which the tubes are of 1.25 cm internal diameter the tolerance required in the manufacture of the tube and interrupter structure is 0.5 mm to 1.0 mm, which is readily realisable.

At the radially inner part of each interrupter element, i.e. where the roots of the blades meet the core rod, there is a maximum of the ratio of blade surface area relative to the path cross-sectional area for fluid flow through the element, so that the friction drag is at a maximum. On the other hand, at the radially outer parts of the element blades the amount of blade material has become substantially zero, so that the friction drag is reduced in relation to the cross sectional area. Because of these differentials in friction and cross sectional area a change of momentum is produced in the fluid as it passes through the element that induces the development of smooth, non turbulent vortices producing rapid and effective mixing of the separated boundary layer and its adjacent core layer for increase in heat exchange efficiency. There is also highly effective contact of the fluid with the surface of the interrupter element and with any material such as a catalytic material thereon. The fluid in these momentum induced vortices moves from element to element longitudinally of the structure, and the spacing between the elements can be made such that what is known as wake interference flow is established by the coincidence between a vortex upstream of an interruption point with vortex downstream of a subsequent interruption point; such wake interference flow is the highest mixing and heat transfer efficiency with lowest required pumping power.

Another of the results of this particular blade configuration is that the fluid flow is predominantly in the radially outer portion of the tube interior with increased fluid velocities particularly at the tube inner wall surface. This type of flow has a number of beneficial effects on the heat transfer efficiency, in that the rate of heat transfer is fundamentally increased because of the rapid flow past the heat transfer surface, while the boundary layer is kept thin and more easily disrupted by the shearing effect of the high velocity fluid.

Figure 5:
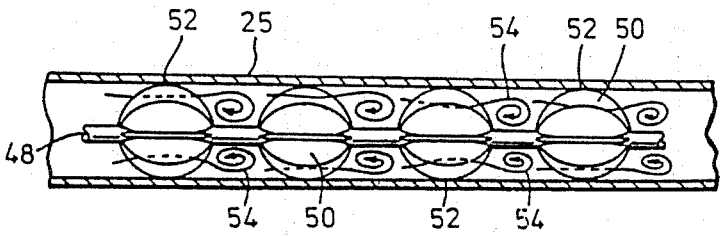
FIG. 5 is a longitudinal cross-section through a single tube illustrating the fluid flow therethrough past an interrupter element.
Figure 6:
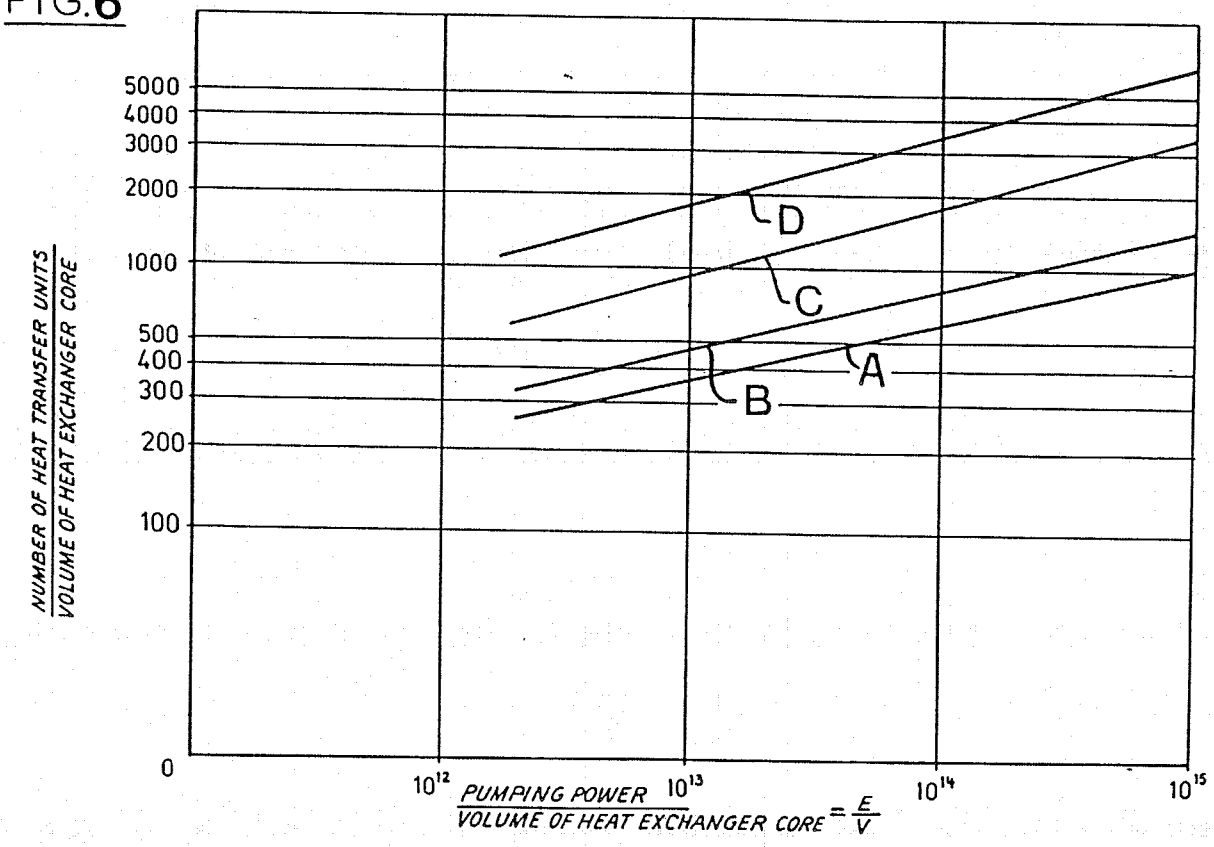
FIG. 6 is a plot of ranking of different heat exchanger surfaces, including a surface/structure combination of the invention.

The general direction of flow of the fluid in a tube is indicated in FIG. 5 by arrows 54 and it will be seen that the flow interrupter structure causes the production of flow eddies of shape and rotational frequency that, as described above, depend upon the geometry of the structure. Wake eddies will be produced around the spots 52 of interruption downstream of the flow, while advance eddies will be produced upstream of the flow. If the spacing of the interruption spots 52 is made such that the advance and wake eddies of immediately successive spots coincide, then the desired wake interference flow is obtained with its very efficient non turbulent mixing between the interrupted boundary layers and the adjacent core layer. A turbulent flow may be distinguished from a vortex or eddy in that the former is irregular and there is no observable pattern as with a vortex. Vortices, eddies and swirls therefore do not constitute turbulence. The conditions for maintenance of non turbulent flow with a particular structure can be observed for example by providing suitable windows in an experimental structure and adding visible fluids to the fluid flow if required.

The interrupter structure may readily be produced relatively inexpensively as a cast or moulded integral element of required diameter, element spacing and element free end length. A variety of different materials can be used, such as metals, non-metallic materials such as plastics materials, and refractory materials such as alumina and cements. Because of its relatively large surface area and its efficient surface contact with the mixing flowing fluid the interruption structure is particularly suited as a support for material with which the fluid is to be contacted, such as a catalytic material. In other embodiments comprising reactor apparatus the interrupter structure itself can be made of the contact and/or catalytic material, and alumina is a specific example of such a material having this dual property.

The number of the blade like members to be with each interrupter element provided is a matter of design for each heat exchanger. A practical minimum is three, while for small exchangers (e.g. using tubes of 1.25 cm and less) more than ten would usually result in too great a loss of flow capacity.

Figure 4A:
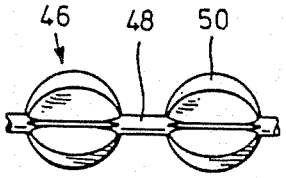
FIGS. 4*a*, 4*b* and 4*c* are respective side elevations to an enlarged scale, and showing interrupter elements of different profiles.
Figure 4B:
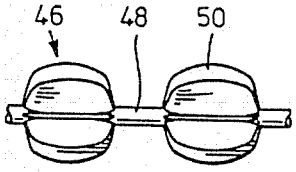
Figure 4C:
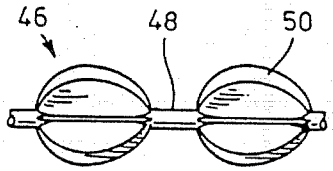

FIG. 4*a* shows in side elevation part of a structure in which the profile of the element is spherical; the profile is of course a circle. Other profiles can be used and should be such as to present smoothly contoured edges to the fluid flow, so as to reduce friction losses to a minimum and also to ensure the maintenance of non turbulent flow. FIG. 4*b* shows for example elements of an ellipsoidal profile, while FIG. 4*c* shows elements of an egg or drop shaped profile.; in the latter two profiles the edge of largest radius faces upstream.

Special situations arise for example when the fluid is very viscous, such as a viscous oil that is to be heated. Such a fluid is usually of low thermal conductivity and a thermal boundary layer will be established immediately adjacent to the heat transfer surface that is much thinner than the flow boundary layer. The interrupting structure must be arranged to interrupt this thinner thermal boundary layer irrespective of the thickness of the flow boundary layer. The principal factor in the determination of the thickness of the thermal boundary layer is the Prandtl number, which is high when the viscosity is high and the thermal conductivity is low.

One of the principal parameters to be considered in determining whether a particular fluid flow will be non turbulent is the Reynolds number which is obtained by the relation:

$$R = \frac{\text{Fluid Mass Velocity} \times \text{Passage Equivalent Diameter}}{\text{Fluid Viscosity}}$$

Classically it was believed that with a Reynolds number less than about 4,000 the flow must be non turbulent, while if it was greater than about 6,000 it would become turbulent. An indication that the flow will be non-turbulent is to plot a friction-factor curve, beginning at low Reynolds numbers, say R=100, which will show an abrupt change in slope at the onset of turbulence. The existence of a friction-factor curve of constant slope can therefore be an indication that essentially non-turbulent flow is occuring.

The evaluation of the performance of heat exchanger surfaces is a difficult subject because of the large number of variables involved, but one method that has gained acceptance is described in the Transactions of the Society of Mechanical Engineers, Vol. 100, August 1978 in a paper by J. G. Soland, W. M. Mack, Jr. and W. M. Rohsenow entitled "Performance Ranking of Plate-Fin Heat Exchanger Surfaces". This method involves the plotting of the number of heat transfer units (NTU) per unit volume of the heat exchanger core (V), against the pumping power (E) required to move the fluid through the core per unit volume of the heat exchanger core (V).

FIG. 7 is a plot of the ranking of surfaces in accordance with this method, comparing surfaces provided with an interrupter structure of the invention with a surface constituted by a tube of 1.2 cm diameter and a plate heat exchanger of 0.5 cm plate pitch. Thus the vertical plot indicates the number of heat transfer units (NTU) per unit volume of the heat exchanger core (V), while the horizontal plot indicates the pumping power (E) required to move the fluid through the core per unit volume of the heat exchanger core (V).

The test fluid was water and the lowest line A is for heat transfer in a plain tube of 1.2 cm diameter, using data obtained from the above-mentioned paper of Soland, Mack and Rohsenow. The line B is for an "APV" plate heat exchanger of 0.5 cm plate pitch, using data obtained from the "APV Heat Transfer Handbook, 2nd Edition, published by APV Inc. of Tonawanda, New York, U.S.A.". It will be seen that line B represents an improvement of 28% in performance over line A. A lower line C plots the performance of a shell and tube heat exchanger of the invention employing seven tubes of 1.25 cm diameter and equipped internally with radially bladed interrupter structures and externally with sphere rods on the shell side with a sphere diameter of 1 cm. The higher line D plots the maximum performance so far obtained with a heat exchanger of the invention. It will be seen that line C represents an improvement of respectively 250% and 200% of lines A and B, while line D represents an improvement of respectively 515% and 400%.

The embodiment of FIGS. 1 to 3 employs a different form of interrupter structure in the fluid path constituted by the space between the shell interior and the tube exteriors, although the above described bladed structure can of course be used. This different structure also consists of a core rod 54, but the longitudinally spaced interrupter elements consist of solid spheres 56 mounted on the rod at the spacing required to provide wake interference fluid flow. These sphere carrying rods, for convenience called sphere rods, are disposed around the tube exteriors with their longitudinal axes parallel to the tube axes and with their spherical surfaces in point contact with the adjacent tube surfaces; at some locations the spheres may also touch one another. The spheres have the same effect of point interruption of the boundary layers and production of mixing vortices that increase the heat transfer from the exterior tube surfaces to the fluid. It will be noted that the ends of the sphere rod cores are free of spheres and are in end engagement with the tube sheets 16, so that they can be located accurately longitudinally; by changing the length of the sphere free ends the spheres of one rod can therefore be arranged to be opposite to the spaces between the spheres on the immediately adjacent rods to ensure the maximum fluid flow capacity in the path, and minimize the pressure drop of the fluid through the shell. The rod ends are also made free of spheres to provide fluid flow plenum spaces of adequate flow capacity in the shell adjacent the inlet and outlet to the shell. The radially outer sides of the radially outermost sphere rods are surrounded by a filler material 58 to block the non heat exchanging flow of fluid that would otherwise take place between the inner wall of the shell and the adjacent outer parts of the tube walls.

It will be seen that the entire heat exchanger is readily disassembled by removal of the encircling band clamps 38 and 42 and split rings 36 and 40, when the tube sheet assemblies can be removed and the interrupter assemblies of both types slid out from inside and between the tubes for replacement or cleaning, as may be required. It will be seen that this disassembly and subsequent reassembly can be effected extremely rapidly by unskilled labour using simple tools. The resulting separate parts can easily be cleaned with simple apparatus.

I claim:

1. In a fluid handling apparatus an interrupter structure adapted for interruption of the boundary layer of a fluid flow at an apparatus surface or surfaces of the apparatus immediately adjacent to the interrupter structure, the said structure comprising:

a multiplicity of bladed interrupter elements disposed longitudinally relative to one another in the direction of flow of the fluid, each interrupter element comprising a common core and at least three blade-like members extending mutually outwardly from the common core so as to separately touch or nearly touch the said apparatus surface or surfaces immediately adjacent to the respective element, each blade-like member being of at least approximately spherical segment profile in side elevation so that the portion thereof most closely adjacent to the respective apparatus surface protrudes into the said fluid flow boundary layer for pointwise interruption in a zone thereof;

each element thereby providing a number of adjacent pointwise boundary layer interruption zones corresponding to the number of blade-like members thereof.

2. The invention as claimed in claim 1, wherein the spacing between immediately successive interrupter elements is such as to produce wake interference flow in the fluid.

3. The invention as claimed in claim 1, wherein the said interrupter structure comprises an axial core member constituted by the respective element common cores connected to one another and along which the interrupter elements are longitudinally spaced from one another.

4. The invention as claimed in any one of claims 1 to 3, wherein the fluid handling apparatus comprises heat exchange apparatus in which the interrupter elements are disposed adjacent the surface of a wall through which heat exchange takes place.

5. The invention as claimed in any one of claims 1 to 3, wherein the fluid handling apparatus comprises heat exchange apparatus of the shell and tube type wherein each tube has therein an interrupter structure.

6. The invention as claimed in any one of claims 1 to 3, wherein the fluid handling apparatus comprises heat exchange apparatus of the shell and tube type, wherein each tube has therein an interrupter structure, and wherein each tube has at least one interrupter structure in contact with its external surface through which heat exchange takes place to fluid in the shell thereof.

7. The invention as claimed in any one of claims 1 to 3, wherein the fluid handling apparatus comprises heat exchange apparatus of the shell and tube type, wherein each tube has therein an interrupter structure, and wherein each tube has at least one interrupter structure in contact with its external surface through which heat exchange takes place to fluid in the shell thereof, each last-mentioned interrupter structure comprising:

an elongated axial core element extending in the direction of fluid flow of the fluid, and a plurality of spaced spherical interrupter elements extending along the said core element.

8. The invention as claimed in any one of claims 1 to 3, wherein the fluid handling apparatus comprises heat exchange apparatus of the shell and tube type wherein each tube has therein an interrupter structure, the interrupter structure being free of interrupter elements at its ends.

9. The invention as claimed in any one of claims 1 to 3, wherein the fluid handling apparatus comprises heat exchange apparatus of the shell and tube type, wherein each tube has therein an interrupter structure, and wherein each tube has at least one interrupter structure in contact with its external surface through which heat exchange takes place to fluid in the shell thereof, each last-mentioned interrupter structure comprising:

an elongated axial core element extending in the direction of fluid flow of the fluid, and a plurality of spaced spherical interrupter elements extending along the said core element, the core element being free of interrupter elements at its ends.

10. The invention as claimed in any of claims 1 to 3, wherein the fluid handling apparatus comprises a fluid reactor in which the interrupter structure is coated with a material exhibiting reactive and/or catalytic properties toward the fluid.

11. The invention as claimed in claim 1, wherein the roots of the blade-like members meet together and define the respective common core.

12. The invention as claimed in claim 3, wherein the roots of the blade-like members meet together and define the respective common core.

13. The invention as claimed in claim 1 or 3, wherein the fluid handling apparatus comprises heat exchange aparatus of the shell and tube type wherein each tube has therein an interrupter structure, and wherein the roots of the blade-like members meet together and define the respective common core.

* * * * *